US006163676A

United States Patent [19]

Levanon et al.

[11] Patent Number: 6,163,676

[45] Date of Patent: Dec. 19, 2000

[54] IMAGING APPARATUS AND IMPROVED EXIT DEVICE THEREFOR

[75] Inventors: Moshe Levanon, Nes Ziona; Oded Sagiv, Chochav Yair; Mark Sandler, Rehovot; David Idan, Mercaz Kafri Ezer, all of Israel

[73] Assignee: Indigo N.V., GA Maastricht, Netherlands

[21] Appl. No.: 09/029,249

[22] PCT Filed: Sep. 9, 1996

[86] PCT No.: PCT/NL96/00354

§ 371 Date: Mar. 4, 1998

§ 102(e) Date: Mar. 4, 1998

[87] PCT Pub. No.: WO97/09262

PCT Pub. Date: Mar. 13, 1997

[30] Foreign Application Priority Data

| | | | |
|---|---|---|---|
| Sep. 8, 1995 | [IL] | Israel | 115227 |
| Oct. 12, 1995 | [IL] | Israel | 115602 |

[51] Int. Cl.[7] ..... G03G 15/16

[52] U.S. Cl. ..... 399/316; 399/397

[58] Field of Search ..... 399/303, 304, 399/305, 307, 397, 398, 302, 308, 309, 316, 313, 318, 121; 347/153, 262, 264

[56] References Cited

U.S. PATENT DOCUMENTS

| | | | |
|---|---|---|---|
| 3,568,286 | 3/1971 | Ross . | |
| 3,730,244 | 5/1973 | Ross . | |
| 3,730,794 | 5/1973 | Ross . | |
| 4,163,549 | 8/1979 | Ito et al. | 271/311 |
| 4,171,157 | 10/1979 | Suzuki | 399/145 |
| 4,287,649 | 9/1981 | Kohler . | |
| 4,430,412 | 2/1984 | Miwa et al. | 430/126 |
| 4,684,238 | 8/1987 | Till et al. . | |
| 4,708,460 | 11/1987 | Langdon . | |
| 4,756,245 | 7/1988 | Roch . | |
| 4,794,651 | 12/1988 | Landa et al. . | |
| 4,842,974 | 6/1989 | Landa et al. . | |
| 4,974,027 | 11/1990 | Landa et al. . | |
| 4,984,025 | 1/1991 | Landa et al. . | |
| 4,985,732 | 1/1991 | Landa et al. . | |
| 5,047,808 | 9/1991 | Landa et al. . | |
| 5,088,404 | 2/1992 | MacConnell et al. . | |
| 5,089,856 | 2/1992 | Landa et al. . | |
| 5,092,235 | 3/1992 | Rise . | |
| 5,117,263 | 5/1992 | Adam et al. . | |
| 5,121,139 | 6/1992 | Burke . | |
| 5,153,656 | 10/1992 | Johnson et al. | 399/303 |
| 5,195,430 | 3/1993 | Rise . | |
| 5,255,058 | 10/1993 | Pinhas et al. . | |
| 5,280,326 | 1/1994 | Pinhas et al. . | |
| 5,289,238 | 2/1994 | Lior et al. . | |
| 5,335,054 | 8/1994 | Landa et al. . | |
| 5,346,796 | 9/1994 | Almog . | |
| 5,455,604 | 10/1995 | Adams et al. . | |
| 5,508,790 | 4/1996 | Belinkov et al. . | |
| 5,552,875 | 9/1996 | Sagiv et al. . | |

FOREIGN PATENT DOCUMENTS

| | | |
|---|---|---|
| 518674 | 12/1992 | European Pat. Off. . |
| 6-16301 | 1/1994 | Japan . |
| 2220888 | 1/1990 | United Kingdom . |
| 9004216 | 4/1990 | WIPO . |
| 9013426 | 11/1990 | WIPO . |
| 9014619 | 11/1990 | WIPO . |
| 9103007 | 3/1991 | WIPO . |
| 9114393 | 10/1991 | WIPO . |
| 9304409 | 3/1993 | WIPO . |
| 9402887 | 2/1994 | WIPO . |
| 9607955 | 3/1996 | WIPO . |
| 9629633 | 9/1996 | WIPO . |
| 9634319 | 10/1996 | WIPO . |
| 9707433 | 2/1997 | WIPO . |

OTHER PUBLICATIONS

Patent Abstract of Japan, vol. 18, No. 224 (M–1596), Apr. 22, 1994.

*Primary Examiner*—Robert Beatty
*Attorney, Agent, or Firm*—Greenblum & Berstein, P.L.C.

[57] ABSTRACT

An imaging apparatus and an improved exit device are provided for guiding a substrate bearing an at least partly deformable image upon exit of the substrate from an image impression region on an image impression surface of an imaging system. The exit device includes an exit roller urged against the image impression surface.

27 Claims, 7 Drawing Sheets

IMAGING APPARATUS AND IMPROVED EXIT DEVICE THEREFOR

FIELD OF THE INVENTION

The present invention relates generally to imaging systems and, more particularly, to printed substrate exit devices of imaging systems.

BACKGROUND OF THE INVENTION

Printed substrate exit devices for imaging and printing systems, such as electrophotographic imaging and printing systems, are known in the art. Exit devices are designed to provide efficient, controlled, exit of the printed substrate from a printing site of the imaging system. The printing site is typically an impression region between the substrate and a member carrying a toner or ink image. In many existing systems, an impression roller provides positive contact between the image carrying member and the substrate.

To provide efficient, slip-free, removal of the printed substrate from the impression region, a portion of the exit device must be urged against the printed side of the substrate. However, to avoid deformation of the yet incompletely fixed image upon exit from the impression region, the exit device preferably includes a smooth surface and the area of contact between the exit device and the printed surface is preferably minimized. Thus, existing exit devices include rigid, smooth elements, for example a plurality of narrow rollers, contacting only a portion of the width of the printed surface. This structure results in slight image deformation, such as loss of glossiness, in the form of streaks corresponding to the regions of contact between the rollers and the printed surface.

PCT Publication WO 93/04409 describes a duplex imaging system having such an exit device. The exit device used in WO 93/04409 includes a pair of thin, rigid, rollers which urge the printed substrate against the impression roller, downstream of the impression region. The exit rollers are rotatably mounted on an axle which is also utilized as part of a substrate deflection arrangement of the duplex imaging system.

Substrate feeder rollers for feeding printing substrate into the impression region are known in the art. Since there is no image on the substrate being fed, there are no particular restrictions on the contact area between the feeding roller and the substrate. Therefore, the feeding roller is typically in contact substantially with the entire width of the substrate. U.S. Pat. No. 4,287,649 describes a substrate feeder-roller which contacts the entire width of the printing substrate. The roller of U.S. Pat. No. 4,287,649 is formed of a thick, spongy, interior coated with a thin, smooth or textured, outer shell.

SUMMARY OF THE INVENTION

The present invention seeks to provide an improved exit device which guides image bearing substrates, out of an image impression region of imaging apparatus, efficiently and substantially without causing deformation of the images printed on the substrates.

The exit device of the present invention includes an elongate exit roller which urges substantially the entire width of the image bearing substrate against the impression roller. The exit roller preferably has a layered structure, including a relatively thick, resilient, relatively soft, inner layer and a thin, rigid, relatively hard, outer layer having a smooth outer surface. During operation of the exit device, the outer surface of the outer layer engages substantially the entire width of the image bearing surface of the substrate. The smoothness of the outer surface and the resilience provided thereto by the inner layer prevent deformation of the unfixed, typically still warm and relatively soft, image impressed on the substrate at the impression region. The large area of contact between the outer surface and the image bearing substrate ensures controlled exit of the image bearing substrate from the impression region.

In one preferred embodiment of the present invention, the exit device is adapted for use with a duplex imaging system, whereby an axis on which the exit roller is mounted is also utilized by a substrate deflection arrangement of the duplex imaging system.

In accordance with a preferred embodiment of the present invention, there is thus provided a device for guiding a substrate bearing an at least partly deformable image, upon exit of the substrate from an image impression region on an image impression surface of an imaging system. The device includes an exit roller which is adapted to engage substantially the entire width of the image bearing substrate and to urge the image bearing substrate against the image impression surface downstream of the image impression region.

In a preferred embodiment of the present invention, the exit roller includes a resilient inner layer and a thin outer layer having a smooth outer surface which engages the substrate bearing the deformable image. The inner layer is preferably formed of a relatively soft material, preferably having a Shore A hardness of less than approximately 40 and, more preferably, between 20 and 30. The outer layer is preferably formed of a relatively hard material, preferably having a Shore A hardness of more than 60 and, more preferably, between 80 and 100.

In a preferred embodiment of the present invention, the exit roller includes a resilient inner layer and a thin outer layer having a smooth outer surface which engages the substrate bearing the deformable image. The inner layer is preferably formed of a relatively soft material, preferably having a Shore A hardness of less than approximately 60 and, more preferably, between 30 and 50, most preferably approximately 40. The outer layer is preferably formed of a relatively hard material, preferably having a Shore A hardness of more than 60 and, more preferably, between 70 and 80.

In a preferred embodiment of the invention, the inner and outer layers both include polyurethane. Preferably, the inner layer includes a solid elastomer material. Preferably, the outer layer includes a room temperature curing material or in a further preferred embodiment includes a thermoplastic material.

In one preferred embodiment of the invention, the outer layer has a smooth outer surface. Alternatively, the outer layer has a textured outer surface.

In a preferred embodiment Qf the invention, the inner and outer layers comprise a single layer and include polyurethane. Preferably, the single layer includes a solid elastomer material. Preferably, the outer surface of the single layer is ground smooth.

In one preferred embodiment of the present invention, the imaging system is a duplex imaging apparatus including an arrangement for deflecting the image forming substrate. In this preferred embodiment of the invention, the substrate deflecting arrangement is associated with an axis of the exit roller.

In a preferred embodiment of the invention, the imaging system includes an electrophotographic imaging system.

BRIEF DESCRIPTION OF THE DRAWINGS

The present invention will be understood and appreciated more fully from the following detailed description, taken in conjunction with the drawings in which.

DETAILED DESCRIPTION OF PREFERRED EMBODIMENTS

Figure 1:
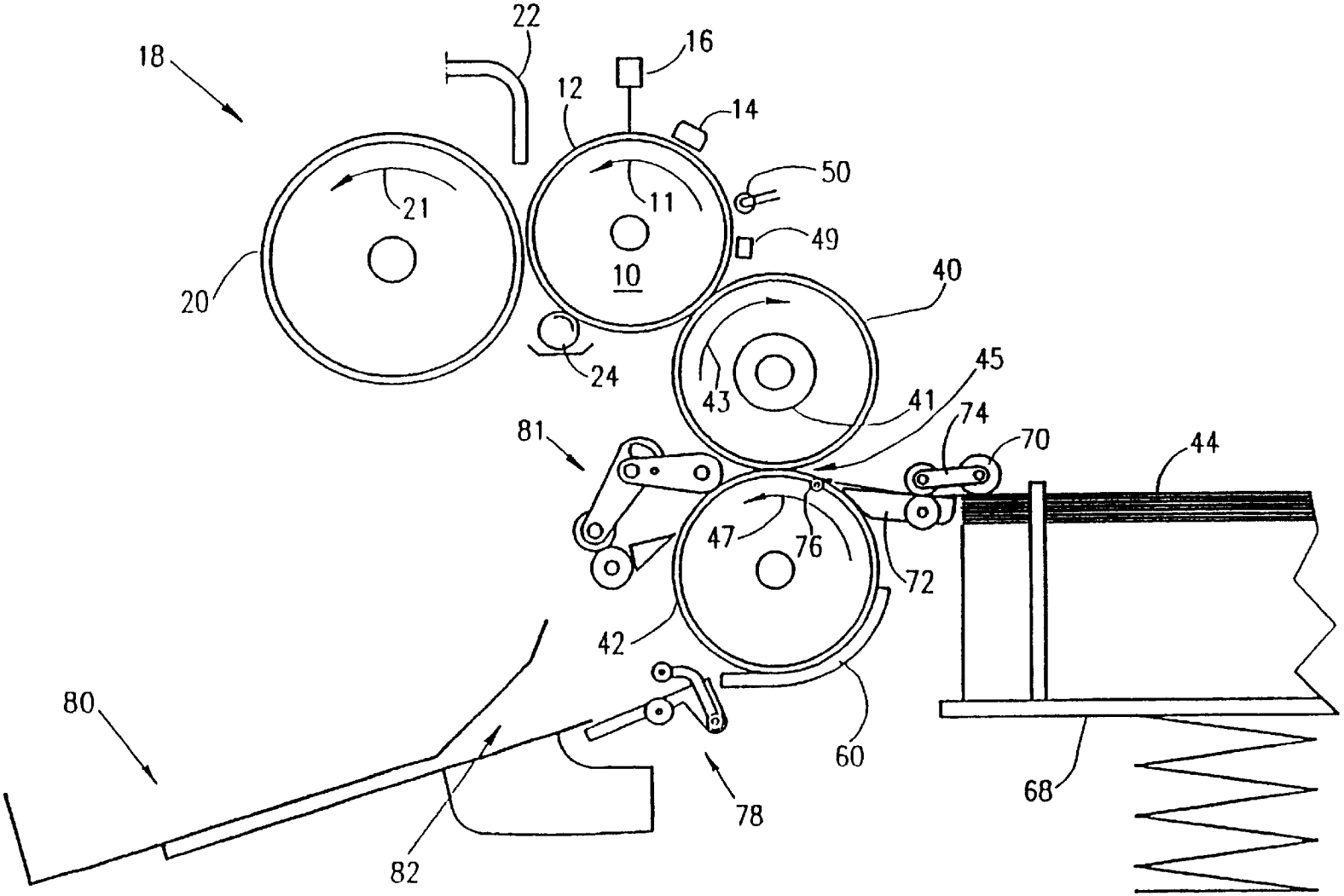
FIG. 1 is a schematic diagram illustrating multi-color, duplex, imagine system constructed and operative in accordance a preferred embodiment of the invention.

Reference is now made to FIG. 1 which illustrates a liquid toner multi-color, duplex, electrophotographic imaging system constructed and operative in accordance with a preferred embodiment of the present invention.

The apparatus of FIG. 1 includes a drum 10 which rotates in a direction indicated by arrow 11 and which has a photoconductive surface 12 made of selenium or any other photoconductor known in the art. As drum 10 rotates, photoconductive surface 12 passes a charging apparatus 14, such as a corona, which is operative to charge photoconductive surface 12 to a generally uniform pre-determined voltage. Further rotation of drum 10 brings charged photoconductive surface 12 past an imager 16, preferably a laser scanner, which is operative to selectively discharge a portion of the charged photoconductive surface by the action of incident light so as to form thereon an electrostatic latent image, the image portions being at a first voltage and the background portions at a second voltage.

Continued rotation of drum 10 brings photoconductive surface 12 bearing the electrostatic latent image into a development region where the latent image is developed by means of a liquid toner developer assembly, referenced generally by numeral 18. Developer assembly 18 includes a developer roller 20, closely spaced from drum 10, and a liquid toner spray apparatus 22. Developer roller 20 typically rotates in the same sense as drum 10, as indicated by arrow 21, such that the surfaces of drum 10 and developer roller 20 have opposite velocities at their region of propinquity. Developer roller 20 is electrified to a voltage that is intermediate the voltages on the background and image portions of the electrostatic latent image on photoconductive surface 12.

Liquid toner spray apparatus 22 supplies liquid toner, containing charged toner particles and carrier liquid, to the area of propinquity between photoconductive surface 12 bearing the latent image and the surface of roller 20. As a result of the relative differences in voltages between the surfaces of roller 20 and the image and background areas of the latent image, toner particles selectively adhere to the image portions of photoconductive surface 12, and the latent image is thereby developed.

In a preferred embodiment of the invention, liquid toner spray apparatus 22 is operative to sequentially provide a multiplicity of pigmented toners, one for each of the process colors, with or without black or other colors, as described in PCT Publication WO 90/14619, the disclosure of which is incorporated herein by reference. Other development apparatus, as known in the art, can also be utilized in imaging apparatus incorporating the present invention.

After the latent image has been developed, photoconductive surface 12 is engaged by an excess liquid removal assembly 24, such as a squeegee roller, which serves to compact the toner image, reduce the amount of carrier liquid therein and remove carrier liquid from the background areas on photoconductive surface 12. Squeegee roller 24 is preferably formed of resilient, slightly-conductive, polymeric material and is charged to a relatively high voltage with the same polarity as that of the toner particle charge.

Downstream of squeegee roller 24, photoconductive surface 12 bearing the developed image is engaged by intermediate transfer member 40, which may be a drum or belt. Intermediate transfer member 40 preferably has a surface comprising a resilient slightly conductive polymeric material, and which may be heated by means of a heater 41. Alternatively or additionally, intermediate transfer member 40 may be charged to an electric potential having a polarity opposite that of the developed image.

Intermediate transfer member 40 rotates in a direction opposite that of drum 10, as shown by arrow 43, such that there is substantially zero relative motion between their respective surfaces where they contact. As both drum 10 bearing the developed latent image and intermediate transfer member 40 rotate, the developed toner image on photoconductive surface 12 is transferred to the surface of intermediate transfer member 40, by electrophoretic transfer as is well known in the art.

Various types of intermediate transfer members are known and are described, for example in U.S. Pat. No. 4,684,238, PCT Publication WO 90/04216 and U.S. Pat. No. 4,974,027, the disclosures of all of which are incorporated herein by reference.

After the toner image has been transferred from photoconductive surface 12 to intermediate transfer member 40, the photoconductive surface is engaged by a cleaning station 49 which may be any conventional cleaning station as is known in the art. A lamp 50 then removes any residual charge which may remain on the photoconductive surface. Drum 10 then returns to its starting position, ready for recharging and an additional imaging cycle.

After the developed latent image has been transferred from photoconductive surface 12 to intermediate transfer member 40 as described above, it is transferred again in a second transfer procedure from intermediate transfer member 40 to a final substrate 44, such as a sheet of paper. Second transfer, generally aided by heat and pressure, occurs as a result of the engagement of the surface of intermediate transfer member 42 with the substrate at a nip 45 formed with the surface of an impression roller 42. Roller 42 rotates in a direction opposite that of intermediate transfer member 40, as indicated by an arrow 47. In a manner more fully described below, the substrate is fed through nip 45 and the developed image is transferred to the side of the substrate facing intermediate transfer member 40. At the point of transfer, the image is at least partially fused and fixed upon the final substrate as a result of the application of heat and pressure at the nip.

Although a wide variety of toners can be used in the present invention, the preferred toners are those that are suitable for at least partial fixing at the point of transfer, for example, the liquid toner of Example 1 of U.S. Pat. No. 4,842,974. When the preferred liquid toners are used, the temperature and pressure at transfer to the substrate is adjusted so that no additional fusing apparatus is necessary for normal handling of the image.

In an alternative embodiment a powder toner development system is used. In such a system the characteristics of the toner and the velocities, temperatures and pressures of the elements involved are such that, preferably, at least partial fixing of the image to the paper takes place during second transfer.

Simultaneous transfer and fusing of liquid toner images is known and described, for example, in U.S. Pat. No. 4,708,460, and in PCT Published Application WO 90/4216, the disclosures of which are incorporated herein by reference.

Substrate 44 is initially fed through nip 45 from a spring-mounted tray 68 (located to the right of impression roller 42) which is adapted to hold individual sheets of paper or any other substrate suitable for receiving the developed image. The uppermost sheet in tray 68 is engaged by a roller 70 which, in response to an appropriate control signal, rotates in a clockwise direction and causes the uppermost sheet to move laterally in the direction of nip 45. The sheet is guided towards the nip by means of a fixed plate 72 and one or more pairs of wheels which are attached to plate 72 and to the end of an arm 74 which is pivotally attached to roller 70. A gripper 76, mounted on impression roller 42, is operative to grip the leading edge of the substrate as it is fed to roller 42. The substrate is then conveyed through the nip in the direction of the rotation of roller 42.

After the substrate has been transported through nip 45 and the developed image transferred to the substrate, gripper 76 releases the substrate from engagement with roller 42. In accordance with a preferred embodiment of the invention, the substrate is then directly conveyed, in a manner more fully described below, either to an output tray 80 or to a waiting station 82. For multi-color imaging requiring separate image transfer for each of the process colors, gripper 76 maintains its grip on the substrate as the substrate is repeatedly conveyed around impression roller 42 and through nip 45 until all the color images have been transferred to the substrate. Only then does gripper 76 release substrate 44 for transport either to output tray 80 or waiting station 82.

Figure 2A:
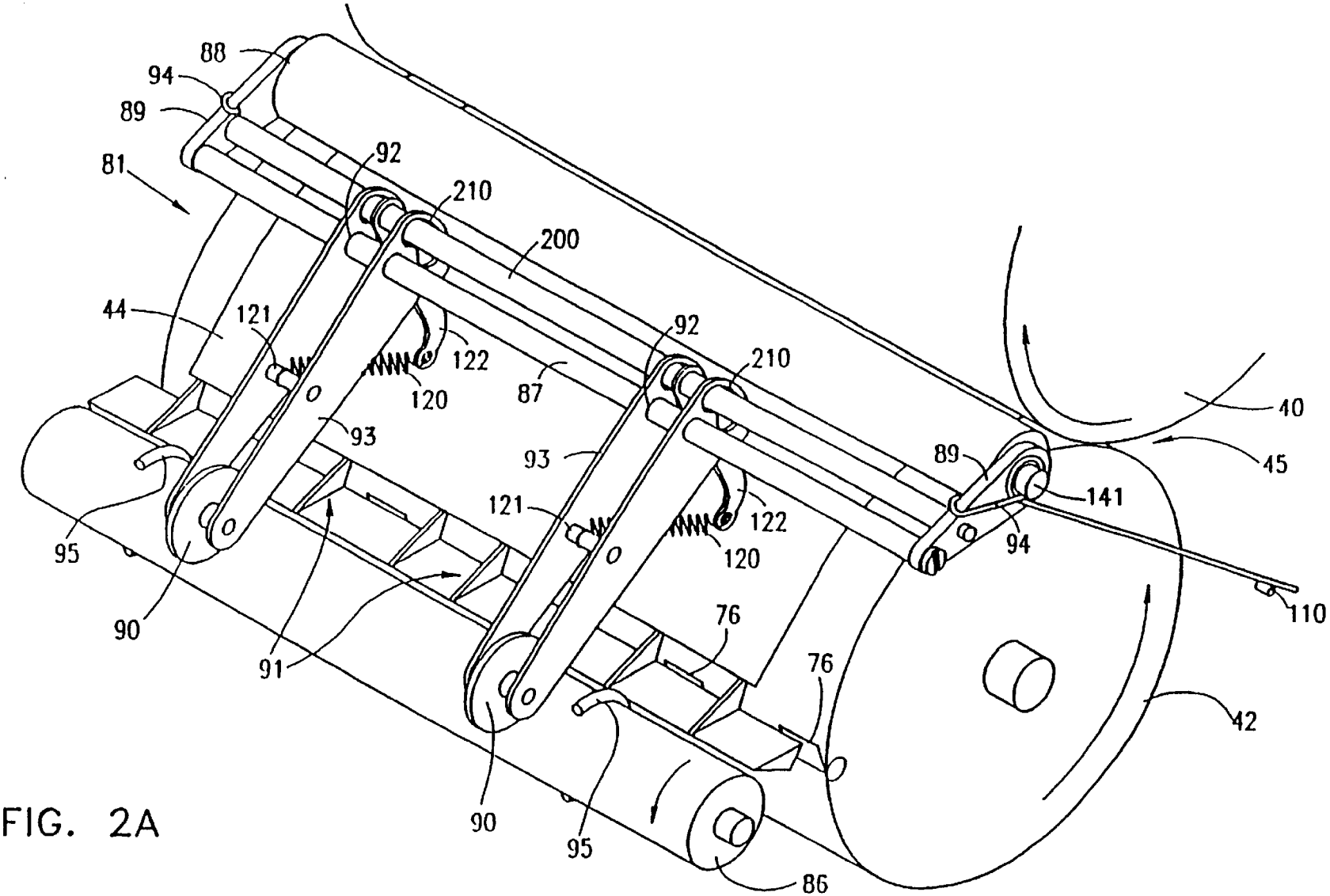
FIG. 2A is a perspective view of substrate deflection apparatus of the duplex imaging system of FIG. 1, incorporating a substrate exit roller in accordance with a preferred embodiment of the present invention.

Reference is now made to FIG. 2A which is a perspective view of substrate deflection apparatus 81 of the duplex imaging system of the present invention, incorporating a substrate exit roller 88 in accordance with a preferred embodiment of the present invention. Deflection apparatus 81 of FIG. 2A includes a shaft 141 which is spaced from impression roller 42 by means of exit roller 88 which freely rotates about shaft 141. Fixedly attached to shaft 141 are first ends of a pair of arms 89 whose second, opposite, ends are fixedly attached to an axle 87. Two pairs of arms 93 are pivotally mounted, by first ends thereof, on axle 87 at pivot regions 92. Pivoting of arms 93 about axle 87 is guided by a pivot guide rod 200 which extends through pivot restricting apertures 210 formed in arms 93. Rotatably attached to the second, free, ends of arms 93 are wheels 90 which engage a motorized roller 86.

A pair of springs 94, which are preferably supported by the ends of shaft 141 and by external supports 110, are operative to spring load wheels 90 on the surface of roller 86. The spring-loading force of spring 94 is transferred to wheels 90 via arms 89 and, in turn, via arms 93. A pair of springs 120 are provided between a pair of spacers 121 of arms 93 and a pair of downward extensions 122 of pivot guide 200, respectively. Springs 120 urge arms 93 with wheels 90 against the surface of roller 86.

After complete transfer of the toner images to the side of substrate 44 being printed, gripper 76 opens and releases the substrate at a point just above stripper 91. The substrate is thus directed away from the surface of impression roller 42 and along the face of stripper 91, in the direction of the nip defined by roller 86 and wheels 90. With roller 86 rotating as shown, the substrate is drawn through the nip and is deflected by the action of the nip either to waiting station 82 (as shown in FIG. 3) or to output tray 80 (as shown in FIG. 4).

Figure 3:
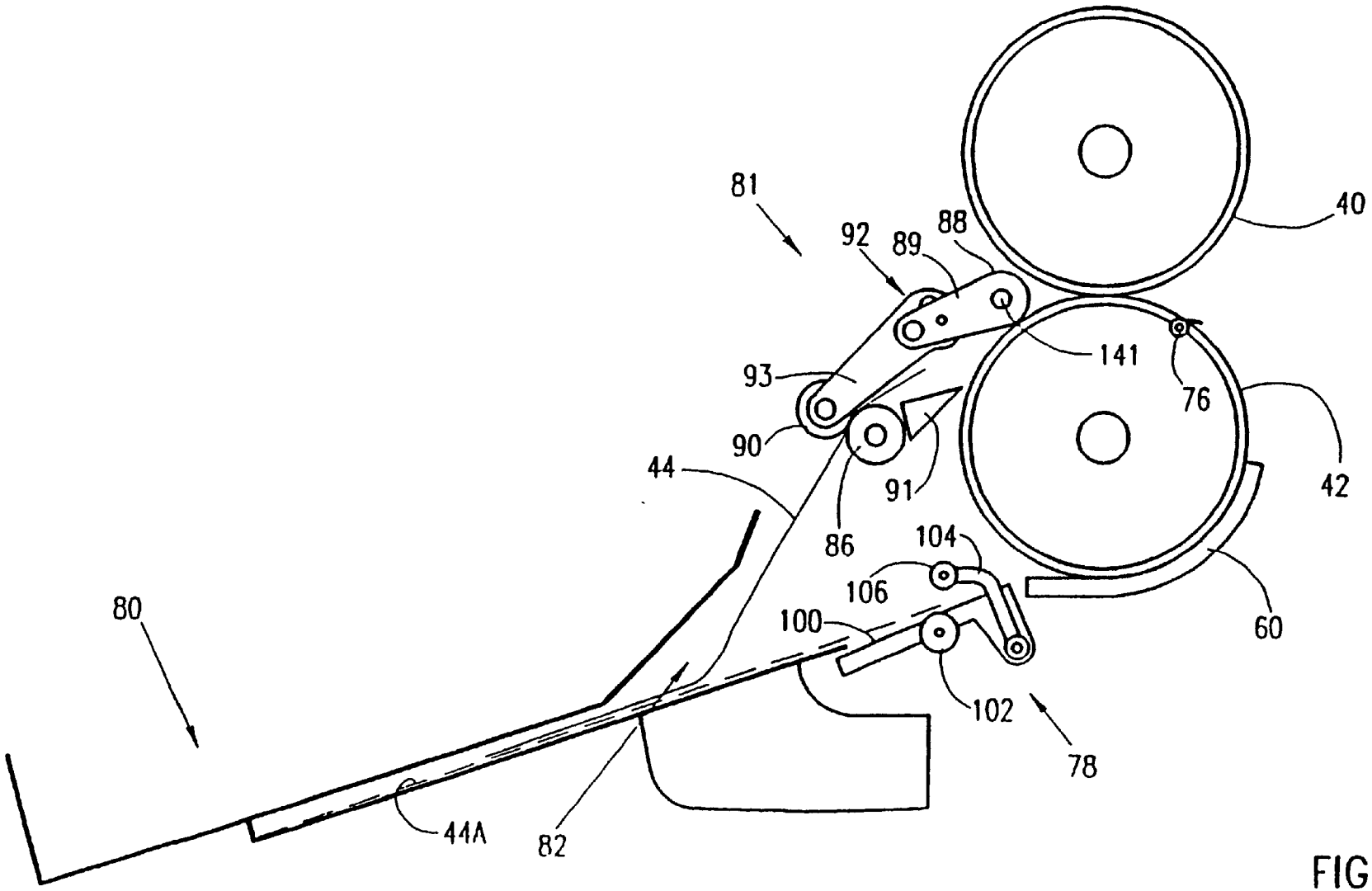
FIG. 3 is a partial side view of the apparatus of FIG. 1 showing operation of the apparatus of FIG. 2A in deflecting a substrate to a waiting station.

When it is desired to print an image on the second side of substrate 44, the substrate is deflected to waiting station 82, as shown in FIG. 3. In such event, prior to the release of the substrate from gripper 76, shaft 141 is rotated slightly in a counter clockwise direction, which results in the extension of arms 89 and 93 at pivots 92 such that the effective angle between arms 89 and 93 is close to 180°. This extension of arms 93 results in a displacement of wheels 90 along the surface of roller 86 in a direction away from impression roller 42. When the substrate is drawn through the nip defined by roller 86 and wheels 90, the angle of release is such that substrate 44 is conveyed to waiting station 82, as shown in FIG. 3. The final delivered position of substrate 44 is indicated by reference number 44A (FIG. 3). It should be note that the trailing edge of the substrate lies on wheels 102, whose function is described below in conjunction with FIGS. 5 and 6 thereof.

Figure 4:
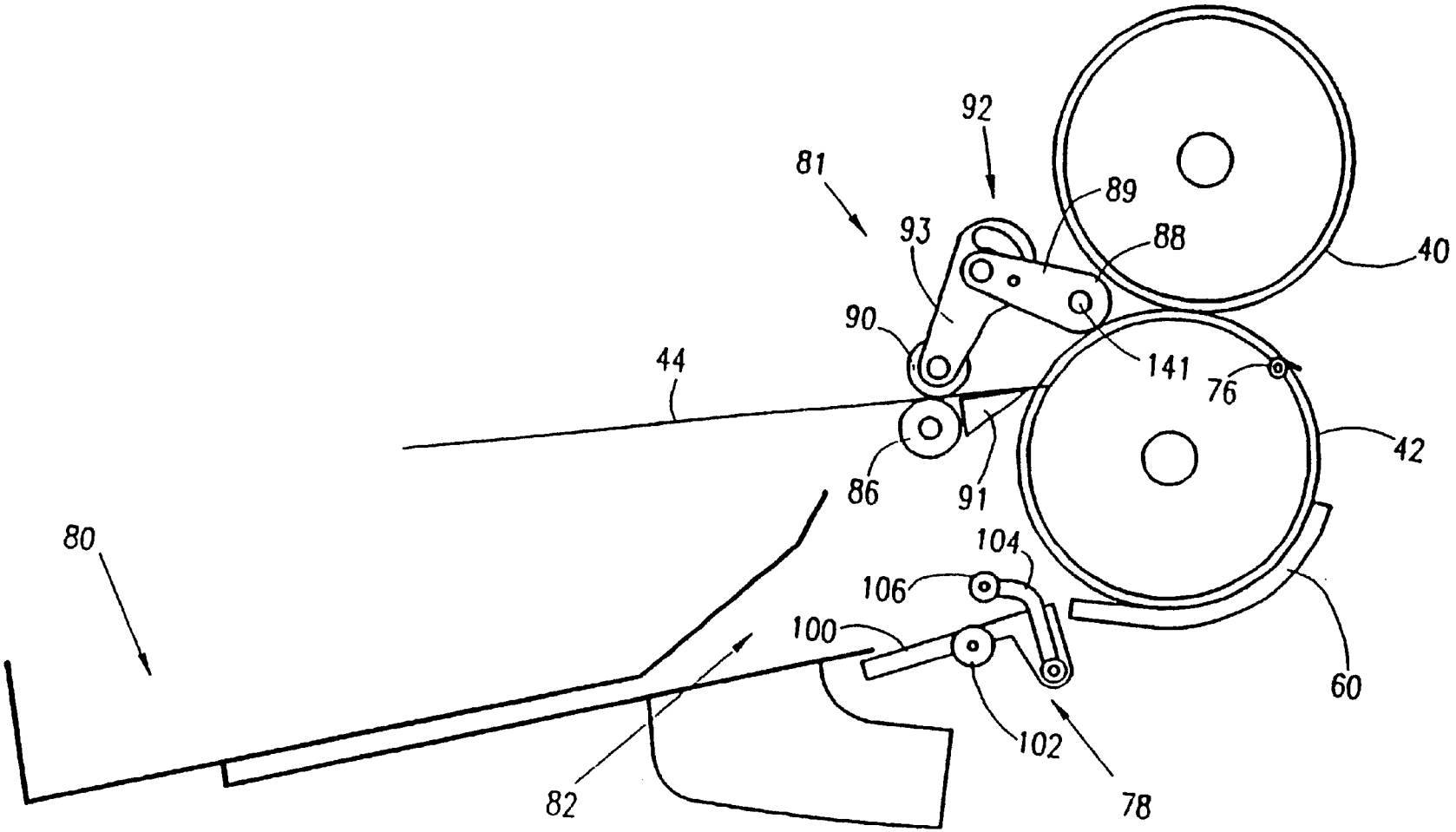
FIG. 4 is another partial side view of the apparatus of FIG. 1 showing operation of the apparatus of FIG. 2A in deflecting a substrate to an output station.

When image transfer to the substrate has been completed (e.g., when printing on both sides of the substrate is complete, or single side printing is desired), the substrate is deflected to output tray 80, as shown in FIG. 4. In such event, prior to the release of the substrate from gripper 76, shaft 141 is rotated slightly in a clock-wise direction, which results in a closing of arms 89 and 93 at pivots 92 such that the effective angle between them is close to 90°. This closing results in an upwards displacement of wheels 90 on the surface of roller 86. When the substrate is drawn through the nip defined by roller 86 and wheels 90, the angle of release is such that substrate 44 is conveyed to output tray 80, as shown in FIG. 4.

A pair of partial rings 95 are situated along roller 86 (but do not rotate with roller 86) to provide for a slight bending of the sides of substrate 44 as it engages roller 86, thereby increasing the apparent stiffness of substrate 44 and assuring that the substrate is properly deflected to output tray 80. Partial rings 95 are positioned so that they do not engage substrate 44 when the substrate is to be delivered to the waiting station, since the additional stiffening would inhibit the required bending of the substrate as it leaves the nip. Rings 95 are slidable along the surface of roller 86 to accommodate different substrate sizes.

Figure 2B:
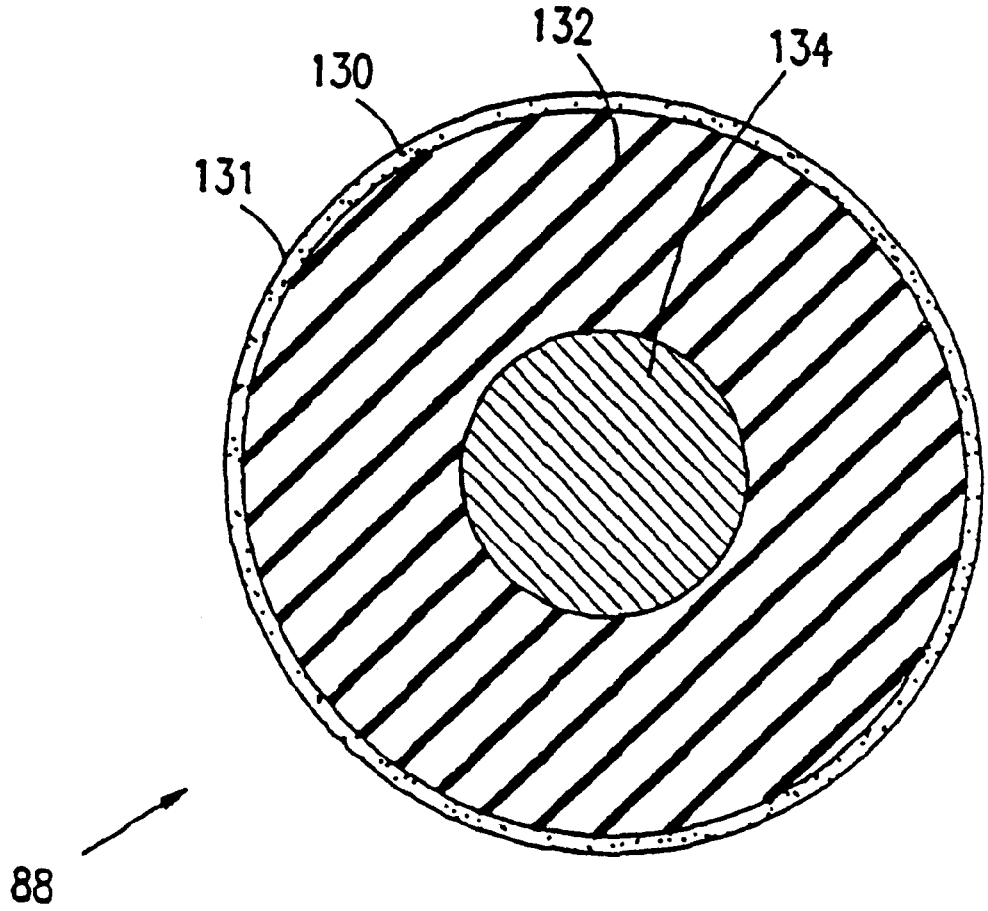
FIG. 2B is a cross-sectional side view of the exit roller of FIG. 2A.

Reference is now made also to FIG. 2B which schematically illustrates a cross-sectional side view of exit roller 88. In a preferred embodiment of the present invention, exit roller 88 has a multi-layered structure which provides a desired interface between the outer surface of the exit roller and the image bearing surface of substrate 44, upon exit of the substrate from image impression nip 45 between impression roller 42 and intermediate transfer member 40. Exit roller 88 includes a rigid, preferably metal, core 134, a thick, resilient, relatively soft, inner layer 132 and a thin, rigid, relatively hard, outer layer 130 having a smooth outer surface 131. Layer 132 is preferably formed of a solid elastomer material, preferably a polyurethane based elastomer, having a Shore A hardness of between 20 and 50. The thickness of layer 132 is preferably on the order of 4 millimeters. Layer 130 is preferably formed of non-elastomer, preferably a polyurethane based thermoplastic material having a Shore A hardness of approximately 90 or even more preferably a polyurethane based room temperature curing material, having a Shore A hardness of approximately 70 to 80. The thickness of layer 130, which is preferably overcoated on layer 132, is preferably approximately 100 micrometers, although the inventors have been successful with materials of up to 400 micrometers.

It is appreciated that, due to the high temperatures involved in transferring the toner image from intermediate transfer member 40 to substrate 44 and fixing the image thereon, the toner image on substrate 44 remains warm and deformable upon exit from impression nip 45. This is because the heat absorbed in impression roller 42, substrate 44 and the toner image itself, during image impression, is not yet dissipated when the toner image comes into contact with exit roller 88. At this point, although the toner image is substantially fixed, the image is still deformable to a certain extent.

In prior art exit devices, where rigid exit rollers are used, at least a portion of the deformable image is slightly deformed upon contact with the exit rollers. The rigid smoothness of outer surface 131 of layer 130, in combination with the resilience of inner layer 132, is operative to prevent such deformation of the toner image upon exit from impression region 45. Furthermore, the relatively large area of contact between surface 131 and the image bearing surface of substrate 44 is operative to ensure controlled exit of image bearing substrate 44 from impression region 45.

It should be noted that the outer surface of the solid, non-spongy, inner layer 132 is relatively smooth and not textured. This feature of layer 132 prevents texturing of surface 131 of the thin, overcoated layer 130, thereby preventing undesired texturing of the deformable toner images. However, in an alternative, preferred, embodiment of the present invention, rigid outer layer 130 is deliberately textured so as to provide a desired texture to the toner images.

It should be further noted that a roller formed of a solid elastomer material, preferably a polyurethane based elastomer, having a Shore A hardness of between 20 and 50 and preferably 40 can be used without an outer coating provided that the outer surface of the solid elastomer material is ground relatively smooth. This process does not produce results satisfactory for printing on transparencies, for example polyester substrates, as the coated rollers disclosed herein.

It should be further noted that an inner layer formed from a spongy material may be used if the outer surface of the layer is relatively smooth. If the smooth outer surface of the layer of spongy material is rigid enough, no outer coating would be required. However, even if the smooth outer layer of the spongy material is rigid enough, this type of roller does not produce results satisfactory for printing on transparencies, for example polyester substrates, as the coated rollers disclosed herein.

In a preferred embodiment of the present invention, exit roller 88 is produced as follows. First, core 134 is coated with a polyurethane adhesive, such as CILBOND 49 SF, and inserted into the center of an aluminum mold which is preheated to a temperature of approximately 100° C. The mold is preferably dip coated with a release agent, such as, for example, a mixture of 9 parts Syl-Off 7600 (Dow Corning), 1 part Syl-Off 7601 and 190 parts n-hexane, which is then cured for about one half hour at 100° C. The material forming layer 132, which is preferably a solid elastomer polyurethane layer having a Shore A hardness of 20, for example PUM2 (Compounding Ingredients Limited, CIL) is preheated to a temperature of approximately 110° C. for approximately one minute to improve potability and filled into the volume defined between core 134 and the mold. The mold is then heated to a temperature of approximately 135° C. and maintained at that temperature for approximately 6 hours. The mold is then cooled-down and removed and layer 132 is ground down to the desired thickness, preferably approximately 4 millimeters.

Core 134 bearing layer 132 is then dip-coated, one end first, in a bath containing a 9% solution of Dow Pelletene 21033 in tetrahydrofuran (THF) and dried for approximately 30 minutes. The layered core is again dip-coated in the solution, with the other end first, and dried. The above described dip-coating is repeated until the desired thickness of layer 130, preferably approximately 80–100 micrometers, is reached. This results in the formation of a non-elastomer thermoplastic polyurethane layer 130 having a Shore A hardness of approximately 90. The dried layer 130 does not require additional treatment such as curing.

In a more preferred embodiment of the present invention, exit roller 88 is produced as follows. A clean mold, preferably made of aluminum, to be used for the casting of the roller inner layer 132 is coated, preferably dip coated, with a release agent, for example CILRelease (Compounding Ingredients Limited, CIL). Core 134 is coated with a polyurethane adhesive, such as CILBOND 49 SF (CIL), and inserted into the center of an aluminum mold. The core is then dried for about one hour at 100° C. The mold is heated to 100° C. during the core drying step. The material forming layer 132, which is preferably a solid elastomer polyurethane layer having a Shore A hardness of 40, for example PUM4 (CIL) is preheated to a temperature of approximately 110° C. for approximately one minute to improve porability and filled into the volume defined between core 134 and the mold. The mold is then heated to a temperature of approximately 135° C. and maintained at that temperature for approximately 6 hours, thereby curing the inner layer of the exit roller 132. The cured exit roller is then allowed to cool to approximately room temperature and is pulled out after dripping Isopar L (Exxon) on the inner surface of the mold. Layer 132 is then ground down to the desired thickness, preferably approximately 4 millimeters.

Core 134 bearing layer 132 is then dip-coated in a bath containing 1A20 (HumiSeal), toluene and xylenes. The coating bath is prepared by mixing 1000 grams of 1A20, 100 grams of toluene and 100 grams of xylenes in a vessel, tightly closing the vessel, shaking the mixture and then filtering the mixture through a cloth filter. Proper coating thickness is achieved by dipping the roller in one direction and pulling it out at a speed of 60 cm/min. The dip coating is dried for approximately 3 hours at room temperature The above described dip-coating is repeated until the desired thickness of layer 130, preferably approximately 100 micrometers, is reached. This results in the formation of a non-elastomer room temperature vulcanizing polyurethane layer 130 having a Shore A hardness of approximately 70 to 80. The dried layer 130 does not require additional treatment such as heat curing.

Figure 5:
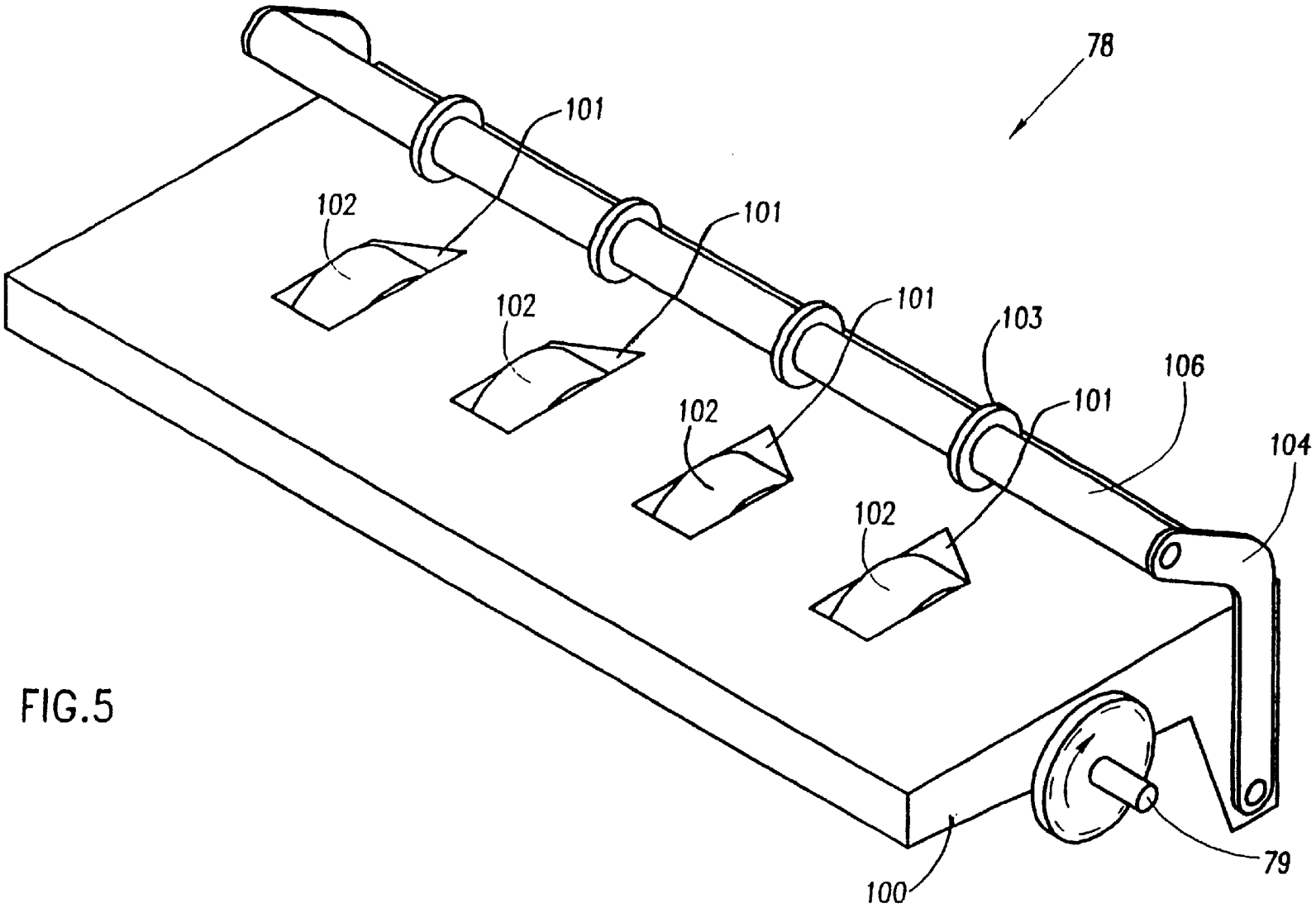
FIG. 5 is a perspective view of substrate transport apparatus of the duplex printing system of FIG. 1, in accordance with a preferred embodiment of the invention.

Reference is now made to FIG. 5 which shows a perspective view of substrate transport apparatus for duplex printing, referenced generally by numeral 78, in accordance with a preferred embodiment of the invention. Transport apparatus 78 preferably includes a set of rubberized wheels 102 which are mounted on a motorized shaft 79 and which protrude through apertures 101 in a plate 100, laterally spaced between impression roller 42 and waiting station 82. Pivotally attached to plate 78 is a curved arm 104, and attached to the opposite end portion of arm 104 is a rod 106. Rod 106 has a set of freely-rotating knurled wheels 103 thereon which are in alignment with wheels 102.

Figure 6:
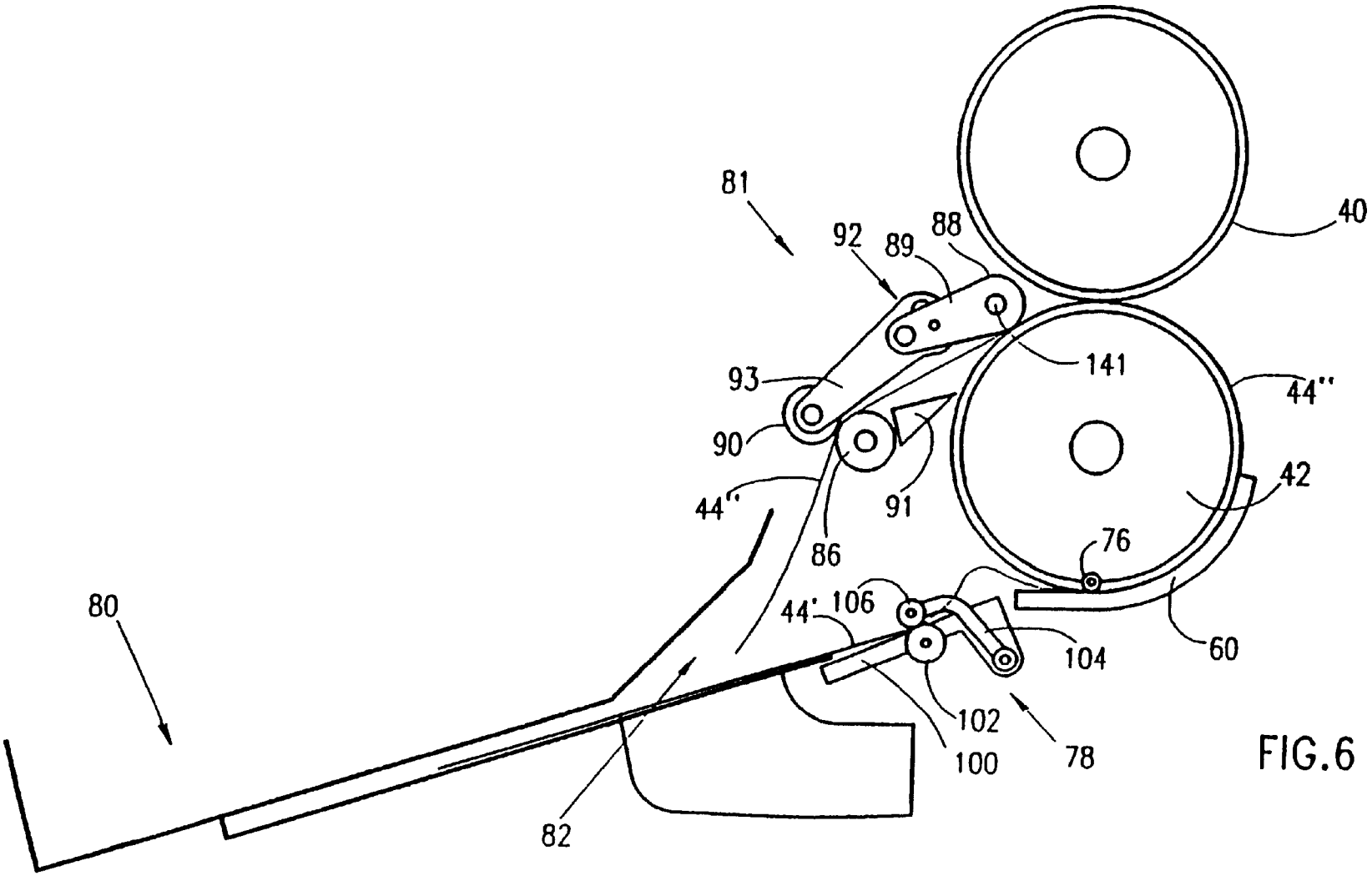
FIG. 6 is a partial side view of the apparatus of FIG. 1 showing operation of the apparatus of FIGS. 2A and 5 with a given sheet entering a waiting station while a previous sheet is removed therefrom.

When the substrate is delivered to waiting station 82, arm 104 is in an "upper" open position, as shown in FIGS. 3 and 5, and what was the trailing edge of the substrate falls upon wheels 102. Upon an appropriate signal, arm 104 pivots to a "closed", lower position, as shown in FIG. 6, and the edge of the substrate is then held within a nip defined by wheels 102 and wheels 103. Motorized shaft 79 and wheels 102 then rotate in a clock-wise direction as shown and transport the substrate through the nip to impression roller 42. Alternatively wheels 102 rotate continuously but only move the paper when arm 104 is closed.

The delivery of the substrate to impression roller 42 is timed such that gripper 76 is appropriately located to receive the edge of the substrate as it reaches roller 42. Preferably, the rotation rate of wheels 102 is such that the paper moves faster than the surface of roller 42. This has a twofold advantage. Firstly, the timing of the closing of arm 104 is less critical, since the arm can be closed late allowing the substrate to buckle as shown in FIG. 6. Secondly, the resulting buckle improves the alignment by allowing the edge of the paper to butt against the grippers. To aid the proper placement of the paper in the gripper arms a guide 60 closely spaced from roller 42 is provided.

The substrate is then fed around impression roller 42 and through nip 45. It will be appreciated that in this pass through nip 45, it is the second side of the substrate which faces intermediate transfer member 42, and duplex image transfer is thereby attained. Since the leading edge of the substrate during duplex transfer had been the trailing edge during image transfer to the first side, the image transferred to the duplex side must be inverted in order to maintain the same orientation on both sides of the substrate.

In some embodiments of the present invention, no more than one substrate is located within waiting station 82 at any given time. As shown in FIG. 6, the apparatus is configured such that a substrate 44' which has been in waiting station 82 is transported back to roller 42 for duplex printing at the same time that another substrate 44" is being delivered to waiting station 82. In this manner, the apparatus is in almost constant operation without any wasted rotations. This allows for continuous duplex printing without complicated re-feed mechanisms or multi-sheet buffer storage. As a result, in the event of jams or other problems causing an interruption in operation, no more than two sheets need be discarded or reprinted when the system is restarted.

It will be appreciated that the duplex printing system thus far described is also suitable for single sided printing and, in the context of duplex printing, several different printing sequences are possible.

In a first, efficient, mode of operation of the imaging apparatus, the first side of a first substrate is printed and the substrate is delivered to waiting station 82. Then the first side of a second substrate is printed. While this substrate is being delivered to waiting station 82, the first substrate is removed therefrom and delivered to the impression roller for printing on its second side. While the first substrate is being delivered to the output tray, the second substrate is removed from the waiting station and delivered to the impression roller for printing on its second side. The second substrate is then delivered to the output tray. This process is repeated until all the required prints are completed.

In a second, efficient mode of operation of the imaging apparatus, the first side of a first substrate is printed and the substrate is delivered to waiting station 82. Then the first side of a second substrate is printed. While this substrate is being delivered to waiting station 82, the first substrate is removed therefrom and delivered to the impression roller for printing on its second side. While the first substrate is being delivered to the output tray, the third substrate is delivered to the apparatus for printing on its first side, followed by printing of the second side of the second substrate. This process of alternately printing the second side of a substrate in the waiting station and the first side of a new substrate continues until all the required prints are completed.

It should be understood that the prints on any two succeeding substrates need not be the same. In fact, the duplexer of the present invention is especially suitable for electronic collation in which a number of successive pages are printed with different images to form a set which is then bound by an optional finisher and delivered from the printer. The images to be printed are preferably stored in a fast memory and are successively delivered to the laser imager for forming the successive images on the surface of drum 10.

Various aspects of the imaging systems which are preferably used in conjunction with the present invention are described, for example, in U.S. Pat. No. 5,508,790 and applications filed in other countries claiming priority therefrom, U.S. Pat. No. 4,985,732, U.S. Pat. No. 5,255,058, PCT Publication WO 90/14619, U.S. Pat. No. 5,289,238, U.S. Pat. No. 5,117,263, U.S. Pat. No. 5,280,326, U.S. Pat. No. 4,794,651, U.S. Pat. No. 5,346,796, PCT Publication WO 94/02887, U. S. Pat. No. 5,089,856, U.S. Pat. No. 5,047,808, U.S. Pat. No. 4,984,025, U.S. Pat. No. 5,335,054, PCT Publication WO 91/03007, PCT Publication WO 91/14393, PCT Publication WO 90/04216, PCT unpublished patent applications PCT/NL 95/00190, PCT/NL 95/00191, and PCT/NL 95/00201, pending Israel patent application 114,992 and PCT Publication WO 93/04409, the disclosures of all of which documents are incorporated herein by reference.

It should be understood that some aspects of the invention are not limited to the specific type of image forming system used and some aspects of the present invention are also useful with any suitable imaging system which forms a substantially fixed, yet deformable, toner image on an image forming surface including, for some aspects of the invention, liquid toner systems and/or powder toner systems. Some aspects of the invention are also useful in systems such as those using other types of intermediate transfer members such as belt or continuous coated drum type transfer members. Some aspects of the invention are suitable for use with offset printing systems. The specific details given above for the image forming system are included as part of a best mode of carrying out the invention; however, many aspects of the invention are applicable to a wide range of systems as known in the art for electrophotographic and offset printing and copying.

It will be appreciated by persons skilled in the art that the present invention is not limited to what has been particularly shown and described hereinabove. Rather, the scope of the present invention is defined only by the claims that follow:

What is claimed is:

1. A printing device comprising:

a printing head, at which an electrostatically formed image is transferred to a substrate having a given width, at an image impression region, the printing head including an image impression surface on which the substrate is supported during said transfer;

a guiding device which guides the substrate from the image impression surface, the guiding device including:

an exit roller which engages substantially the entire width of the substrate and urges the image bearing substrate against the image impression surface downstream of the image impression region, the substrate bearing an at least partly deformable electrostatically formed image thereon when it is engaged by the exit roller, wherein the exit roller comprises a resilient inner layer and a thin outer layer having a smooth outer surface which engages the image bearing substrate.

2. A device according to claim 1 wherein the inner layer is formed of a relatively soft material.

3. A device according to claim 2 wherein the inner layer has a Shore A hardness of less than approximately 60.

4. A device according to claim 2 wherein the inner layer has a Shore A hardness of less than approximately 40.

5. A device according to claim 2 wherein the inner layer has a Shore A hardness of less than approximately 30.

6. A device according to claim 1 wherein the outer layer is formed of a relatively hard material.

7. A device according to claim 6 wherein the outer layer has a Shore A hardness of more than 60.

8. A device according to claim 6 wherein the outer layer has a Shore A hardness of between 70 and 80.

9. A device according to claim 6 wherein the outer layer has a Shore A hardness of between 80 and 100.

10. A device according to any of claims 1–5 wherein the inner layer comprises polyurethane.

11. A device according to any of claims 1–5 wherein the inner layer comprises a solid elastomeric material.

12. A device according to any of claims 1–5 wherein the inner layer comprises a spongy layer, wherein the spongy layer has a relatively smooth outer surface.

13. A device according to any of claims 1 and 6–9 wherein the outer layer comprises polyurethane.

14. A device according to any of claims 1 and 6–9 wherein the outer layer comprises a thermoplastic material.

15. A device according to any of claims 1 and 6–9 wherein the outer layer comprises a room temperature vulcanizing material.

16. A device according to claim 1 wherein the exit roller comprises a polyurethane layer on a hard core.

17. A device according to claim 16 wherein the surface of the polyurethane layer is formed by grinding.

18. A device according to claim 1 wherein the exit roller comprises a spongy layer on a hard core, wherein the spongy layer has a relatively rigid outer surface.

19. A device according to any of claims 1–9 wherein the printing device is a duplex imaging apparatus comprising an arrangement for deflecting the image forming substrate and wherein the substrate deflecting arrangement is associated with an axis of the exit roller.

20. A device according to claim 2 wherein the outer layer is formed of a relatively hard material.

21. A printing device comprising:

a printing head, at which an electrostatically formed image is transferred to a substrate having a given width, at an image impression region, the printing head including an image impression surface on which the substrate is supported during said transfer;

a guiding device which guides the substrate from the image impression surface, the guiding device including:

an exit roller which engages substantially the entire width of the substrate and urges the image bearing substrate against the image impression surface downstream of the image impression region, the substrate bearing an at least partly deformable electrostatically formed image thereon when it is engaged by the exit roller, wherein the exit roller comprises a polyurethane layer on a hard core.

22. A device according to claim 21 wherein the surface of the roller is formed by grinding.

23. A printing device comprising:

a printing head, at which an electrostatically formed image is transferred to a substrate having a given width, at an image impression region, the printing head including an image impression surface on which the substrate is supported during said transfer;

a guiding device which guides the substrate from the image impression surface, the guiding device including:

an exit roller which engages substantially the entire width of the substrate and urges the image bearing substrate against the image impression surface downstream of the image impression region, the substrate bearing an at least partly deformable electrostatically formed image thereon when it is engaged by the exit roller, wherein the exit roller comprises a spongy layer on a hard core, wherein the spongy layer has a relatively rigid outer surface.

24. A printing device comprising:

a printing head, at which an electrostatically formed image is transferred to a substrate having a given width, at an image impression region, the printing head including an image impression surface on which the substrate is supported during said transfer;

a guiding device which guides the substrate from the image impression surface, the guiding device including:

an exit roller which engages substantially the entire width of the substrate and urges the image bearing substrate against the image impression surface downstream of the image impression region, the substrate bearing an at least partly deformable electrostatically formed image thereon when it is engaged by the exit roller, wherein the printing device is a duplex imaging apparatus comprising an arrangement for deflecting the substrate and wherein the substrate deflecting arrangement is associated with an axis of the exit roller.

25. A device according to any of claims 1–9 or 21–24 wherein the exit roller is unheated other than by heat transferred from the substrate.

26. A printing device comprising:

a printing head, at which an electrostatically formed image is transferred to a substrate having a given width, at an image impression region, the printing head including an image impression surface on which the substrate is supported during said transfer;

a guiding device which guides the substrate from the image impression surface, the guiding device including:

an exit roller which engages substantially the entire width of the substrate and urges the image bearing substrate against the image impression surface downstream of the image impression region, the substrate bearing an at least partly deformable electrostatically formed image thereon when it is engaged by the exit roller, wherein the exit roller is unheated other than by heat transferred from the substrate.

27. A device according to any of claims 1–9 or 21–24 wherein the image is fused prior to its reaching the exit roller.

* * * * *